US007567000B2

(12) United States Patent
Sugiyama et al.

(10) Patent No.: US 7,567,000 B2
(45) Date of Patent: Jul. 28, 2009

(54) MOTOR

(75) Inventors: Tomotsugu Sugiyama, Kyoto (JP); Shinji Takemoto, Kyoto (JP); Tsuyoshi Yasumura, Kyoto (JP)

(73) Assignee: Nidec Corporation, Kyoto (JP)

( * ) Notice: Subject to any disclaimer, the term of this patent is extended or adjusted under 35 U.S.C. 154(b) by 364 days.

(21) Appl. No.: 11/564,443

(22) Filed: Nov. 29, 2006

(65) Prior Publication Data

US 2007/0122293 A1 May 31, 2007

(30) Foreign Application Priority Data

Nov. 29, 2005 (JP) ..... 2005-344744

(51) Int. Cl.
*H02K 9/00* (2006.01)

(52) U.S. Cl. ..... 310/64; 310/67 R

(58) Field of Classification Search ..... 310/67 R, 310/64, 91; 417/423.7
See application file for complete search history.

(56) References Cited

U.S. PATENT DOCUMENTS 5,173,628 A * 12/1992 Yoshida et al. ..... 310/71
5,879,141 A * 3/1999 Yokozawa et al. ..... 417/423.7
5,903,073 A * 5/1999 Mukai ..... 310/64
6,175,171 B1 * 1/2001 Rupp et al. ..... 310/52
6,208,052 B1 * 3/2001 Kershaw et al. ..... 310/91
6,713,907 B2 * 3/2004 Matsumoto ..... 310/67 R

FOREIGN PATENT DOCUMENTS

JP 61-113563 U 7/1986

* cited by examiner

*Primary Examiner*—Quyen Leung
*Assistant Examiner*—Leda Pham
(74) *Attorney, Agent, or Firm*—Keating & Bennett, LLP

(57) ABSTRACT

A motor includes a heat dissipating structure. The motor may be used for a fan and includes on an upper surface of a circuit board a heat dissipating layer. The heat dissipating layer has a high thermal conductivity. The fan also includes a coil provided on the teeth of a stator core. The heat dissipating layer and the coil axially face each other, and thermal conductive members are arranged therebetween. An outer dimension of the circuit board is greater than that of an impeller cup so that a radially outward portion of the circuit board protrudes radially outwardly from the impeller cup. The heat generated by the coil is transferred to the heat dissipating layer via the thermal conductive members. Therefore, the heat is dissipated from a wide area, which efficiently dissipates heat from the fan. In addition, since the circuit board and the heat dissipating layer protrude radially into an air-flow generated by an impeller, the heat transferred to the heat dissipating layer is actively dissipated.

9 Claims, 10 Drawing Sheets

MOTOR

BACKGROUND OF THE INVENTION

1. Field of the Invention

The present invention generally relates to a motor equipped with a coil, more particularly, relates to a heat dissipating structure of the motor to dissipate heat generated by the armature.

2. Description of the Related Art

With numerous fans and drive motors for heat dissipation, disk drives, and like applications being installed in electronic devices, high speed motor operation is being demanded, in part because the demand for high speed data transfer and high heat dissipating capacity is increasing. A motor which rotates at a high speed is one answer to this need. In such a motor, however, a large electric current flows into a coil of an armature of the motor, and the coil generates considerable heat. The heat may substantially compromise reliability and endurance of the motor since a copper wire used for the coil has a temperature limit and the generated heat influences bearing life.

A motor having a heat dissipating structure is one answer to the demand for high-speed motor operation. One example of such a structure for an axial fan is to provide outside air into an impeller cup which accommodates a coil via a through hole on an upper surface of the impeller cup. In this structure, however, air which flows into the impeller cup via the through hole is limited. With such limited air flow, only limited heat will be dissipated from the coil of the motor.

SUMMARY OF THE INVENTION

In order to overcome the problems described above, preferred embodiments of the present invention provide a motor having a structure that dissipates heat generated by an armature (e.g., a coil of the armature) of the motor in an effective manner.

According to a preferred embodiment of the present invention, an electric motor used for a fan includes a shaft, a stator core having a plurality of teeth, a coil having a looped wire at each of the teeth, a circuit board arranged axially below the stator core, a heat dissipating layer arranged on an axially upper surface of the circuit board extending along the upper surface of the circuit board, and a thermal conductive member arranged between the coil and the heat dissipating layer so as to be in contact with both. By virtue of this configuration, heat generated by the coil is diffused to the heat dissipating layer via the thermal conductive member and is dissipated from the heat dissipating layer.

According to another preferred embodiment of the present invention, the circuit board includes a protruding portion arranged radially outside an impeller cup of the motor. According to yet another preferred embodiment of the present invention, at least a portion of the heat dissipating layer is arranged on the protruding portion. In case that the motor according to a preferred embodiment of the present invention is used for a fan, the heat may be actively dissipated from the heat dissipating layer arranged radially outside the impeller cup by air flowing thereto.

Other features, elements, steps, processes, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
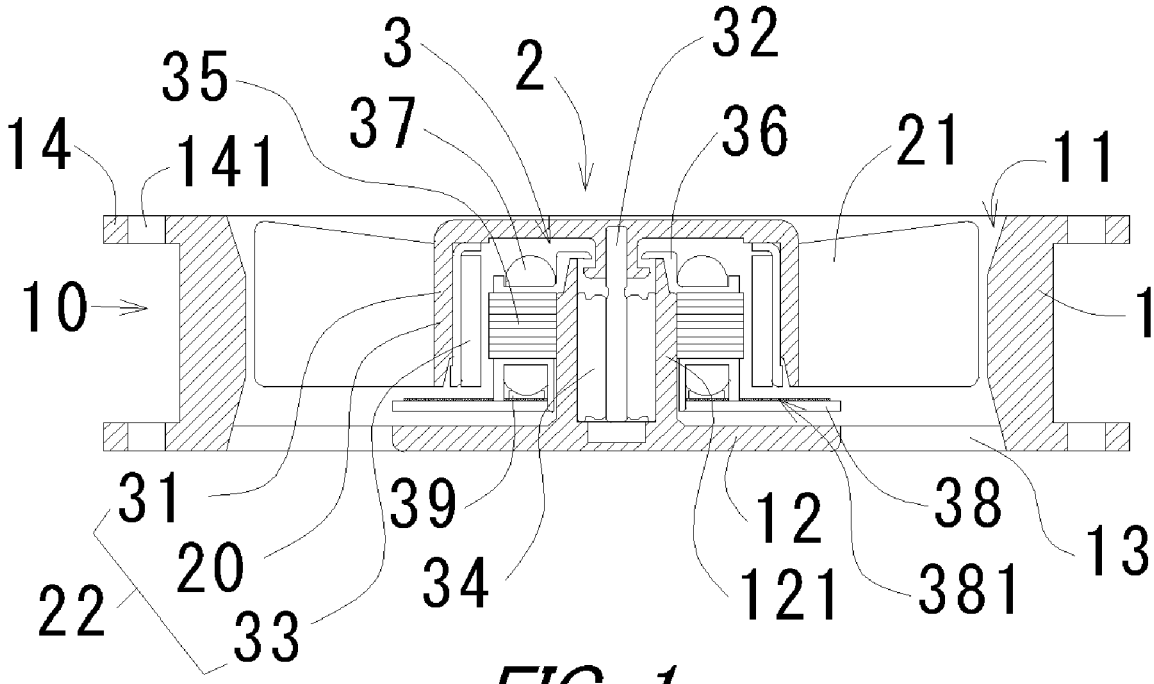
FIG. 1 is a cross sectional view of a fan according to a first preferred embodiment of the present invention.

Referring to FIGS. 1 to 10, a motor according to preferred embodiments of the present invention will be described in detail. It should be understood that in the following description, when positional relationships among and orientations of the different components are described as being such as top/bottom, up/down or left/right, positional relationships and orientations that are in the drawings are indicated, and positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

First Preferred Embodiment

Figure 2:
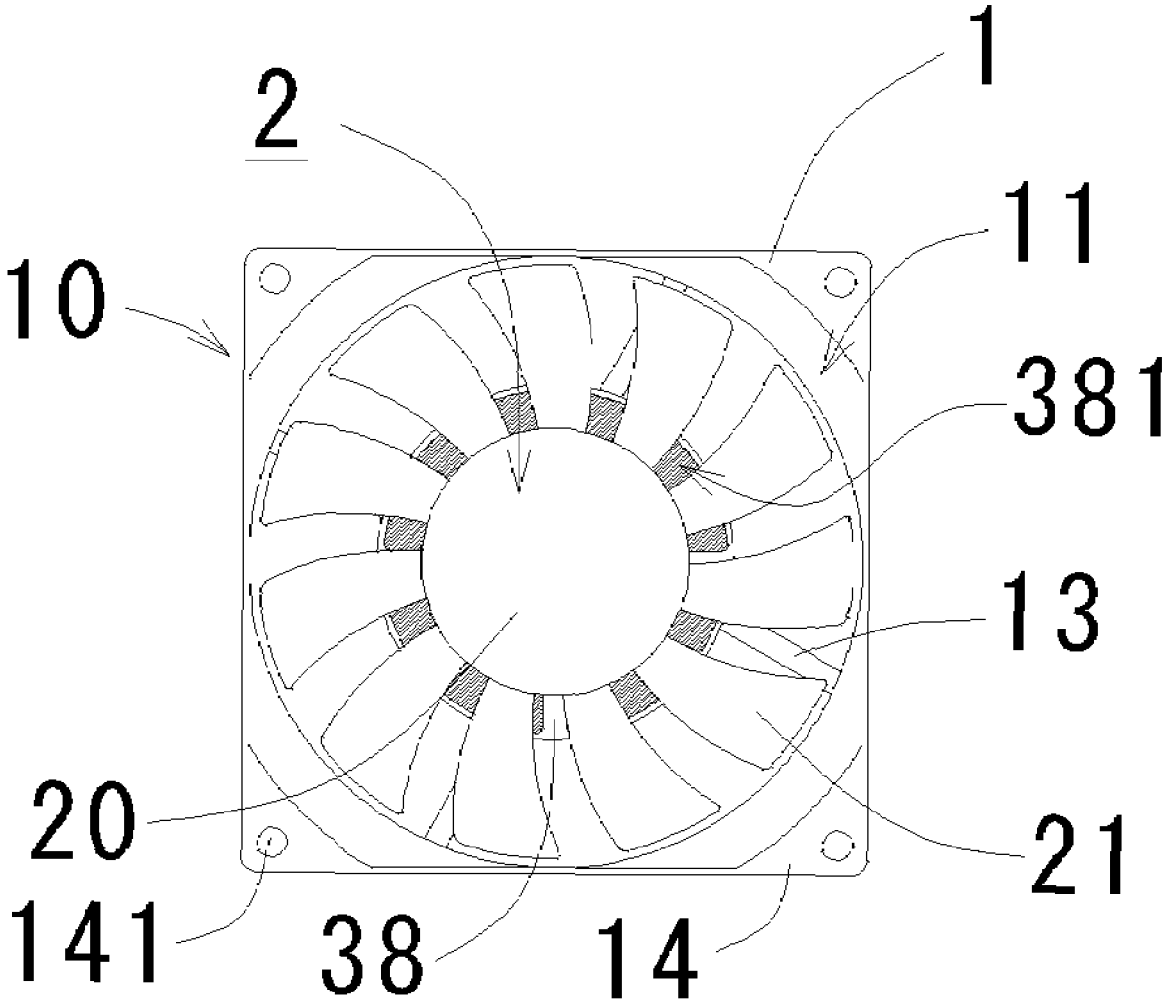
FIG. 2 is a plan view of the motor according to the first preferred embodiment of the present invention.

Referring to FIGS. 1 and 2, a configuration of the fan 10 according to a first preferred embodiment of the present invention will be described. A fan 10 includes an impeller 2 having a plurality of impeller blades 21. The impeller 2 is rotatably driven with electricity supplied to the fan 10. The impeller 2 includes a substantially cup-shaped impeller cup 20, and a plurality of impeller blades 21 are arranged around an outer circumferential surface of the impeller cup 20. The fan 10 includes a shaft 32, of which an upper tip portion is mounted to a substantially center portion of the impeller 2 in a fixed manner.

The fan 10 includes a frame 12 having a bearing housing 121 at a middle portion thereof. The bearing housing 121 has a substantially cylindrical shape with a base connected to the frame 12. A radial bearing 34 is press-fitted and supported within the bearing housing 121. The radial bearing 34 includes a through hole extending in the axial direction at a middle portion thereof, and the shaft 32 is inserted into the through hole. In the present preferred embodiment of the present invention, the radial bearing 34 is an oil-impregnated bearing made of porous material (e.g., a sintered material impregnated with lubricating oil). It should be noted, however, a roller bearing (e.g., a ball bearing) or the like may be used instead of the radial bearing 34.

Four ribs 13 are arranged in a circumferentially equally spaced manner. Each of the four ribs 13 extends radially between the frame 12 and a housing 1. However, the fan 10 may include any suitable number of ribs 13.

The housing 1 radially surrounds the impeller 21 and defines an air-flow passage 11 through which air flow generated by the rotation of the impeller 2 passes. The housing 1 has a substantially square shape on its upper and lower end portions, and has a substantially circular shape at its middle portion, whose diameter is substantially the same as a length of a side of the square. Therefore, each of the upper and bottom ends of the housing 1 includes flange portions 14 protruding radially outwardly at four corners of each of the upper and lower end of the housing 1. Each of the flange portions 14 includes a mounting hole 141 for mounting the fan 10 on an electronic device. For example, a screw or the like may be inserted into the mounting hole 141 and tightened so as to mount the fan on the electronic device.

A rotor yoke 31 is arranged on a radially inner circumferential surface of the impeller cup 20 to reduce leakage of magnetic flux to outside of the fan 10. A rotor magnet 33, of which a radially inside portion is multipolar-magnetized, is arranged on a radially inner side of the rotor yoke 31. The impeller cup 20, the impeller 2, the rotor yoke 31, and the rotor magnet 33 define a cup portion 22.

Figure 5:
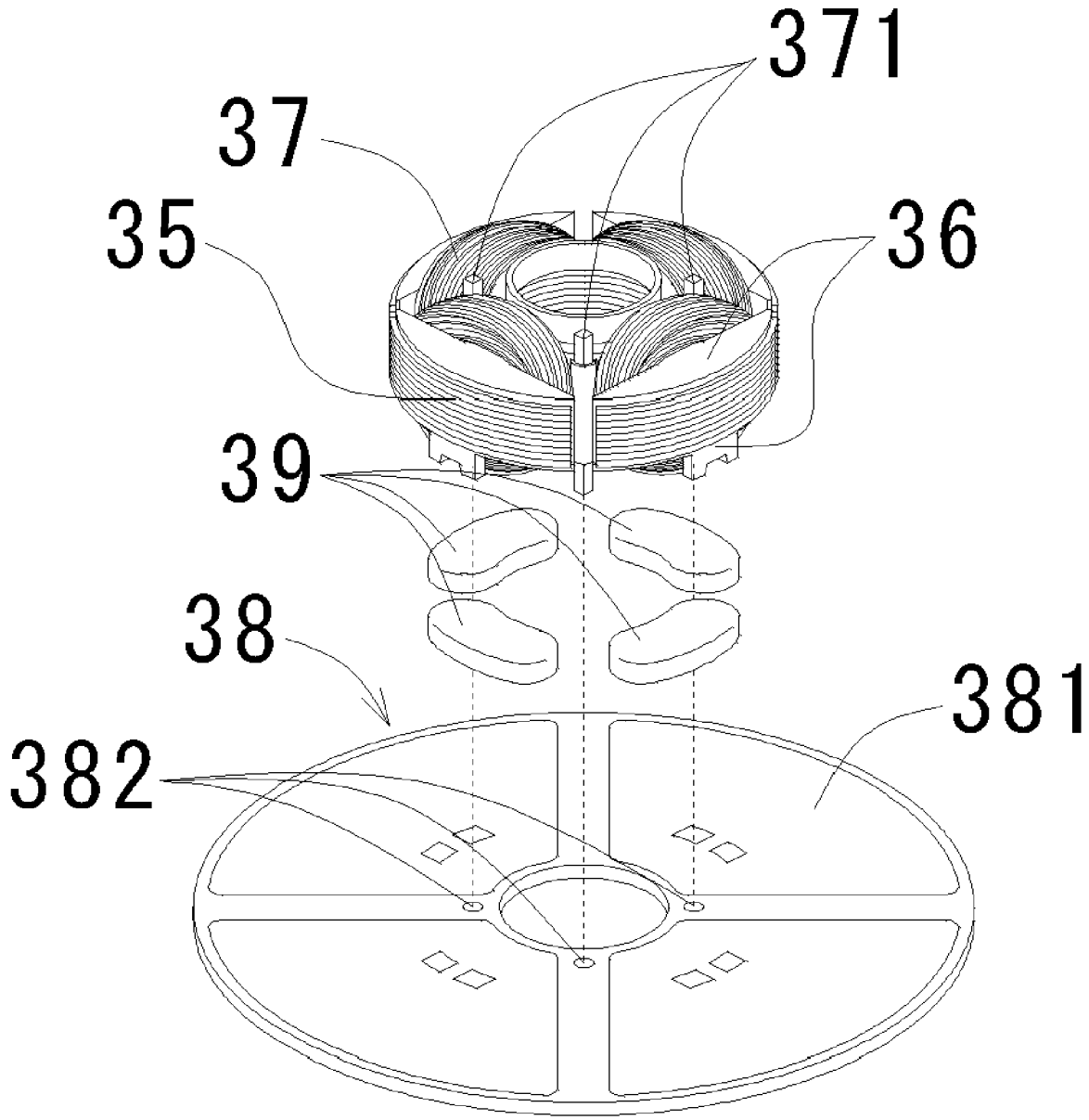
FIG. 5 is a perspective view illustrating in detail the stationary part according to another preferred embodiment of the present invention.

A stationary part 3 is arranged radially outside of the bearing housing 121. The stationary part 3 includes a stator core 35, coils 37, an insulator 36, a circuit board 38, and a thermal conductive member 39. The stator core 35 includes a plurality of teeth, and radially-inward-tip ends of the teeth radially face the rotor magnet 33 with a gap maintained therebetween. The teeth and both axial side surfaces of the stator core 35 are covered by the insulator 36. A looped wire is provided on each of the teeth so as to form a coil 37 thereon. A circuit board 38 supplying an electric current to the coil 37 to control rotation of the impeller 2 is arranged at a bottom end portion of the stationary part 3 (i.e., on the insulator 36 at a bottom end portion of the stator core 35). Electronic components and circuit patterns (not shown in FIG. 1) are arranged on an axial bottom side of the circuit board 38 so as to form a series of electronic circuits. As shown in FIG. 5, a pin 371, to which one end of the coil 37 is twined, is mounted on the insulator 36 in an axially penetrating manner while the pin 371 is insulated by the stator core 35. One end of the coil 37 is twined to one axial side of the pin 371, and an end of the pin 371 is inserted into a pin insertion bore 382 arranged on the circuit board 38. Then, the end of the pin 371 is soldered to the circuit board 38 such that the coil 37 is electrically connected to electronic components on the circuit board 38.

Upon providing electricity from an external power source to the coil 37 via electronic components (e.g., an IC and a Hall element arranged on the circuit board 38), a magnetic field is generated around the stator core 35. The magnetic field interacts with another magnetic field generated by the rotor magnet 33, and torque which rotates the impeller 2 centered about the shaft is generated. The magnetic field changes slightly based on the rotation of the rotor magnet, and the Hall element detects the change in the magnetic field. Based on the signal from the Hall element, the IC switches the output voltage such that the impeller 2 rotates stably. Upon rotation of the impeller 2, the fan 10 takes air from an upper end opening of the air-flow passage 11 and discharges air from a bottom end opening thereof.

Figure 4:
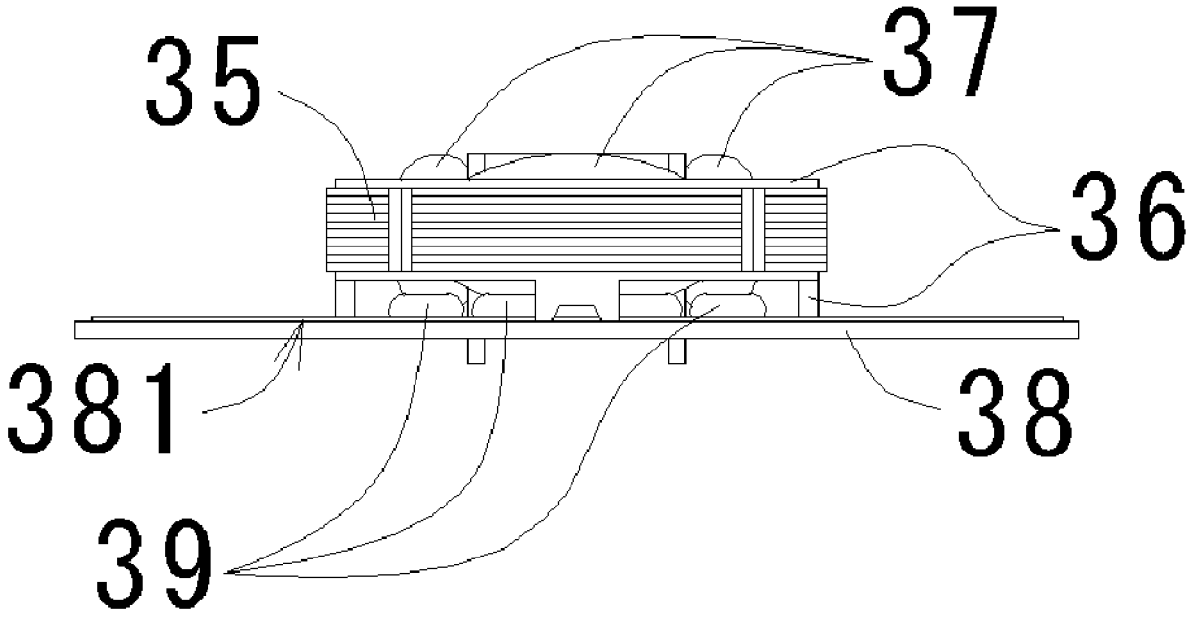
FIG. 4 is a side view illustrating in detail a stationary part according to another preferred embodiment of the present invention.

Referring to FIGS. 4 and 5, a heat dissipating structure of the motor according to a preferred embodiment of the present invention will be described in detail.

As shown in FIGS. 4 and 5, a heat dissipating layer 381 made of a material having high thermal conductivity is arranged on an upper surface of the circuit board 38. In this preferred embodiment of the present invention, the heat dissipating layer 381 is preferably made of a copper material, the same material as circuit patterns printed on the circuit board 38. By virtue of this configuration, the heat dissipating layer 381 may be formed simultaneously with the circuit patterns. The heat dissipating layer 381 may be coated with solder or the like to prevent oxidation. It should be noted that the heat dissipating layer 381 may be made of any material having a preferred thermal conductivity. However, the heat dissipating layer may be provided as a separate member from the circuit board 38. For example, a thermal conductive sheet may be attached to the upper surface of the circuit board 38.

The heat dissipating layer 381 is circumferentially divided into a number of areas, each of which corresponds to a coil 37 arranged on each of the teeth. The coil 37 and the heat dissipating layer 381 are arranged so as to axially face each other with the thermal conductive member 39 arranged axially therebetween. The thermal conductive member 39 is in contact with the coil 37 and the heat dissipating layer 381 such that heat generated by the coil 37 is diffused to the heat dissipating layer 381. For the purpose of heat diffusion, it is advantageous that the thermal conductive member 39 has a wide contacting area with the coil 37 and the heat dissipating layer 381. In the present preferred embodiment, the thermal conductive member 39 includes a gelled material such as a thermal-conductive silicone resin, including silicone oil as a base oil and a high thermal conductive material (i.e., alumina). The thermal-conductive silicone resin is deformed along shapes of the coil 37 and the heat dissipating layer 381. By virtue of this configuration, the thermal conductive member 39 may have a wide contacting area with both the coil 37 and the heat dissipating layer 381.

It should be noted, however, that the thermal conductive member 39 may be other than a gelled material. Taking workability into account, the thermal conductive member 39 may be a tape-like member (e.g., a thermal tape formed by applying pressure-sensitive adhesives with a filler on a supporting substrate such as polyimide film, fiberglass mat, aluminum foil, etc.). The thermal conductive member 39 may include any material having high thermal conductivity. However, it should be noted that the coil 37 and the heat dissipating layer 381 should be electrically isolated to prevent short circuiting the coil 37. In the present preferred embodiment, even in case that the coil 37 and the heat dissipating layer 381 are electrically connected, short circuiting of the coils does not occur since the heat dissipating layer 381 is circumferentially divided.

As shown in FIGS. 1 and 2, an outer dimension of the circuit board 38 is larger than that of the impeller cup 20. Therefore, a radially outward portion of the circuit board 38 (i.e., a protruding portion) is arranged radially outside of the outer circumferential surface of the impeller cup 20. A portion of the heat dissipating layer 381 is arranged on the protruding portion of the circuit board 38, thus the heat dissipating layer 381 includes a portion arranged radially outside of the impeller cup 20. It is not necessary that an entire circumference of the circuit board 38 is arranged radially outside of the impeller cup 20, that is, only a portion of the circuit board 38 may be arranged radially outside of the impeller cup 20.

The coil 37 generates heat in accordance with the electric resistance thereof and an amount of the electricity provided thereto. In the present preferred embodiment, the heat generated by the coil 37 is diffused to the heat dissipating layer 381 via the thermal conductive member 39. The greater an area from which the heat is dissipated from the heat dissipating layer 381, the greater the heat will automatically dissipate into the air. In addition, the air flow generated by the impeller 2 is provided to the heat dissipating layer 381 such that the heat diffused to the heat dissipating layer 381 is actively dissipated. Therefore, it is possible to provide more electricity to the motor to rotate the motor at a greater speed compared to a conventional motor.

Figure 3:
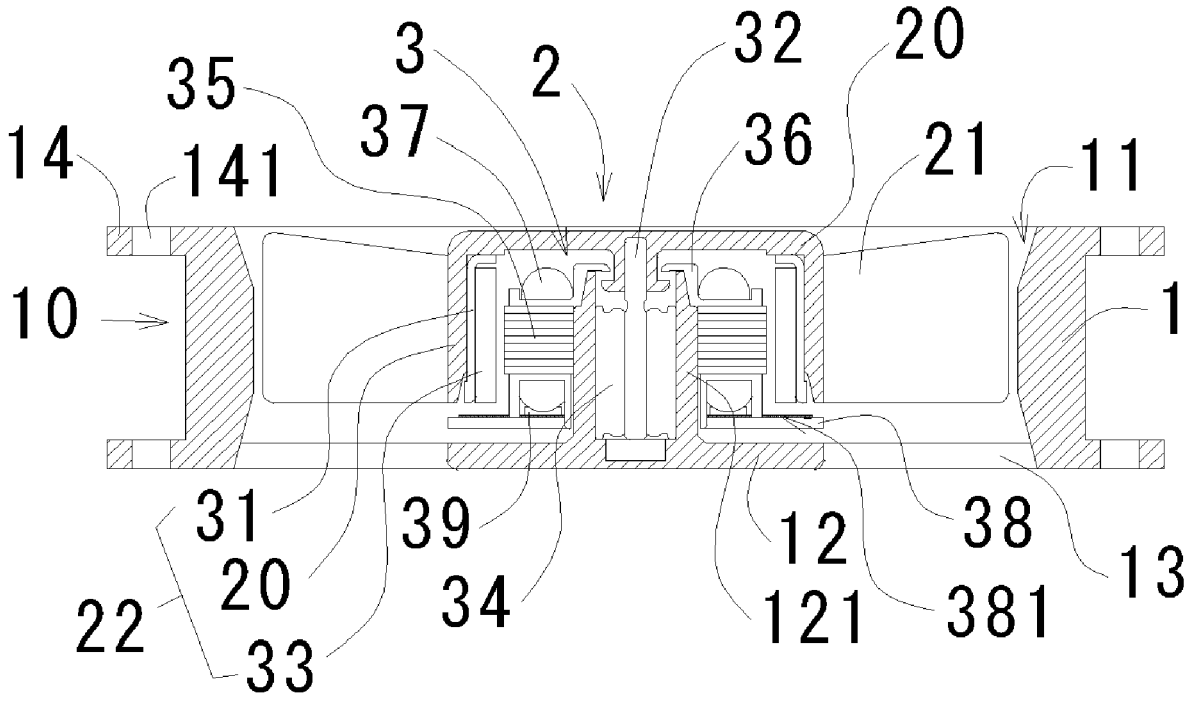
FIG. 3 is a cross sectional view illustrating a modified example of the circuit board mounted on the fan according to the first preferred embodiment of the present invention.

FIG. 3 describes a modified example of the first preferred embodiment of the present invention. A circuit board 38 illustrated in FIG. 3 is not arranged radially outside of the impeller cup 20. Even in this case, air slightly flows to the outer circumferential portion of the circuit board 38. Therefore, with the heat dissipating layer 381 and the heat conductive member 39, the heat generated by the coil 37 is actively dissipated from the heat dissipating layer 381. As described above, regardless of the outer dimension of the impeller cup 20, an outer dimension of the circuit board 38 may be varied based on various parameters (e.g., an electronic-component layout, air volume, static sound pressure, sound level and/or the like).

Second Preferred Embodiment

Referring to FIGS. 6 to 10, a second preferred embodiment of the present invention will be described in detail. In the description that follows, similar configurations described in the first preferred embodiment are labeled with the same reference numerals in the explanation that follows. In the second preferred embodiment of the present invention, the motor is used for a fan.

Figure 6:
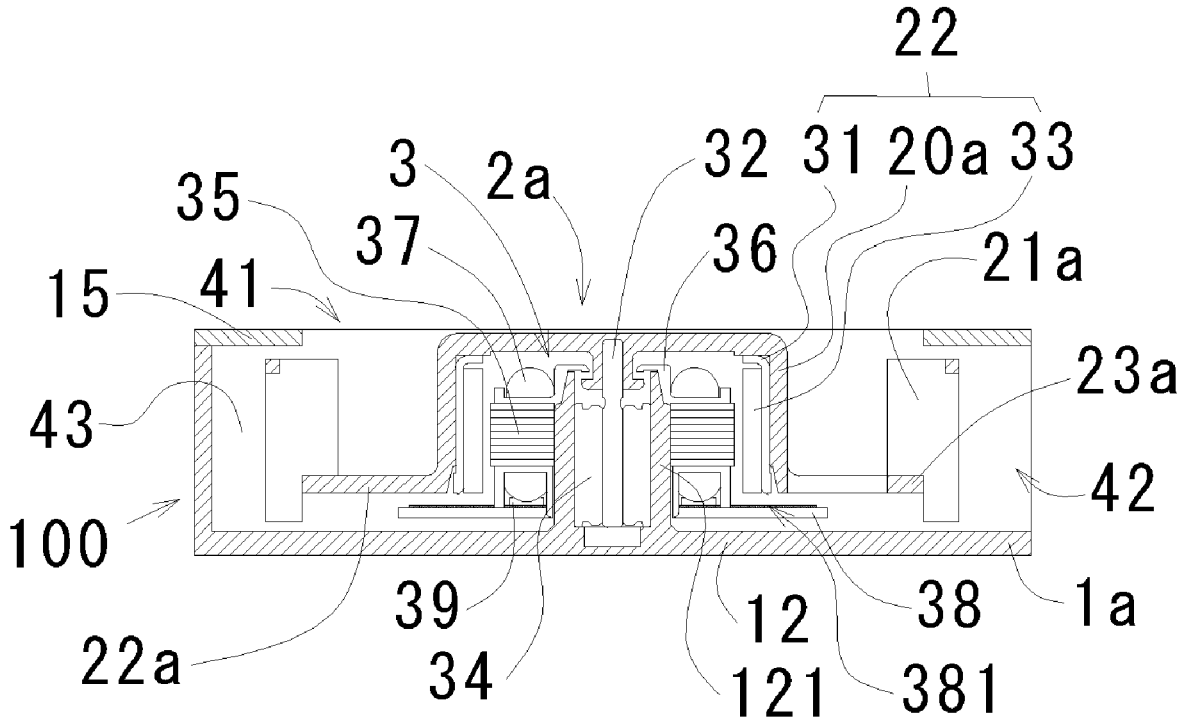
FIG. 6 is a cross sectional view of a fan according to a second preferred embodiment of the present invention.
Figure 7:
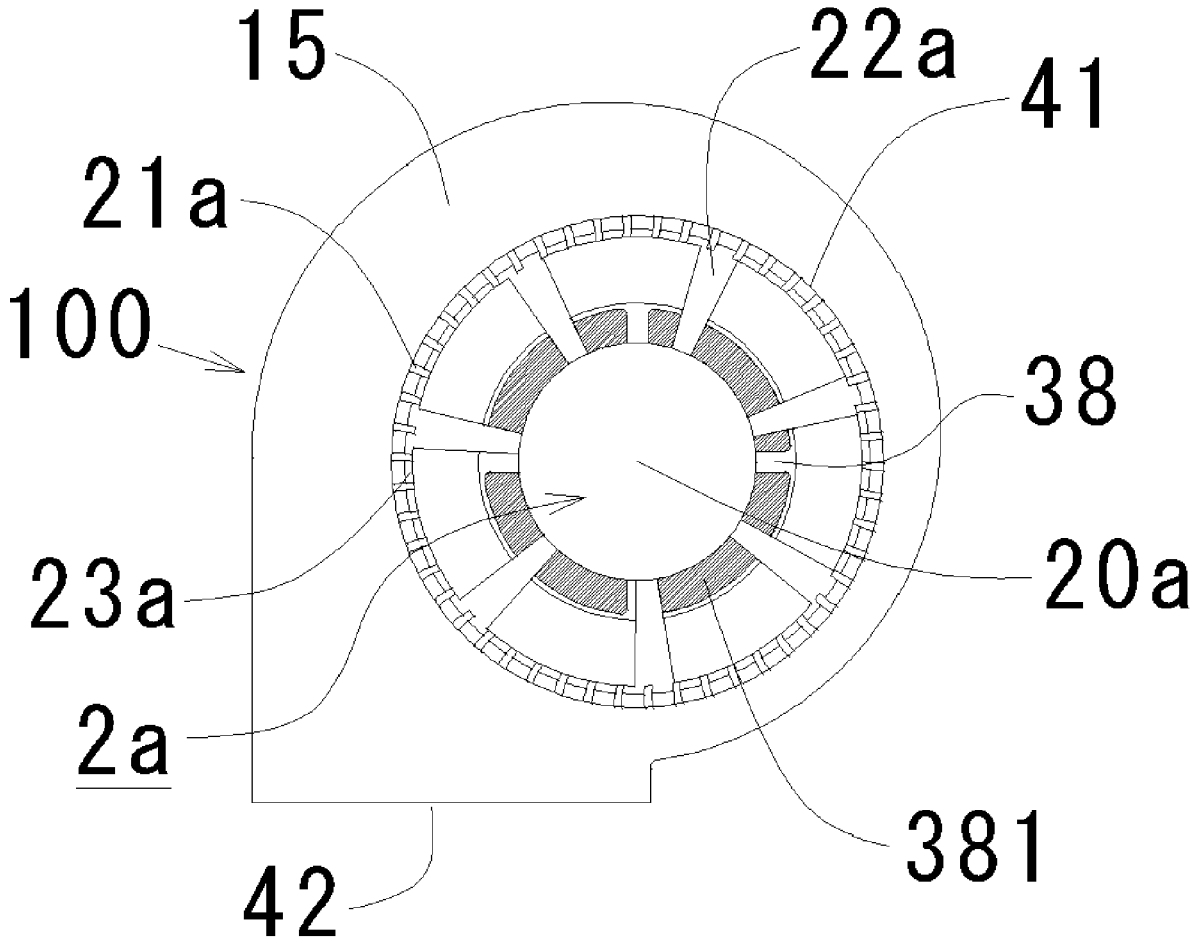
FIG. 7 is a plan view of a fan according to the second preferred embodiment of the present invention.
Figure 8:
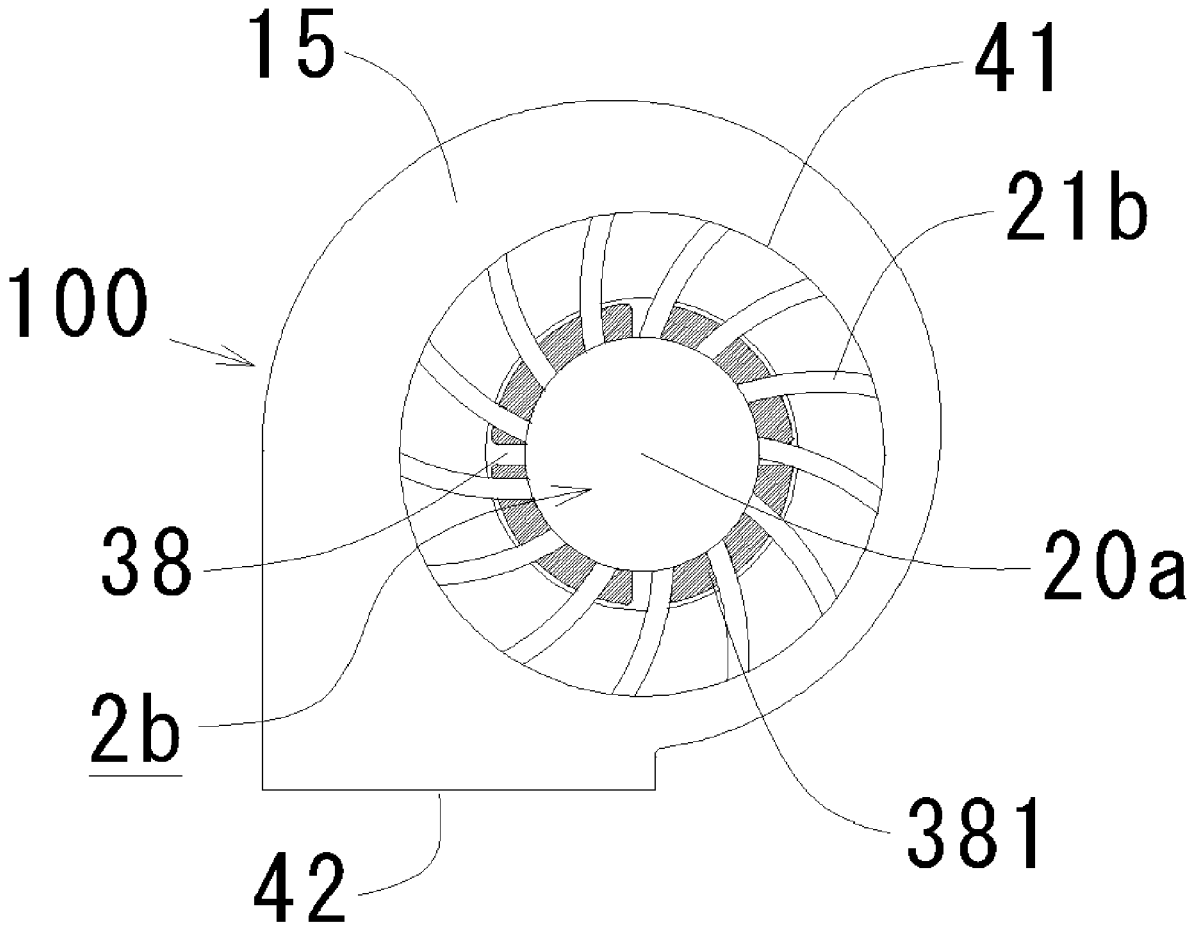
FIG. 8 is a plan view of a fan having an impeller according to a modified example of the second preferred embodiment of the present invention.

A fan 100 includes an impeller 2*a* having a plurality of impeller blades 21*a*. The impeller 2*a* is rotatably driven when electricity is supplied to the fan 100. As shown in FIGS. 6 and 7, the impeller 2*a* includes a substantially cup-shaped impeller cup 20*a*. A plurality of impeller blades 21*a* extending axially are arranged in a circular manner radially outside of the impeller cup 20*a*. The impeller blades 21*a* arranged in a circular manner are connected with a circular impeller-supporting portion 23*a* in a fixed manner. The impeller supporting portion 23*a* is connected to the impeller cup 20*a* with a plurality of connecting portions 22*a*. The fan 100 includes a shaft 32, of which an upper tip portion is mounted to a substantially center portion of the impeller 2*a* in a fixed manner. Upon rotation of the impeller 2*a*, air is taken from an axially upward end and discharged in a radially outward direction. It should be noted that a shape of the impeller 2*a* is not limited to that described above. For example, the impeller 2*a* may be a shape shown in FIG. 8, in which a plurality of impeller blades 21*b* are arranged at an outer circumferential surface of the impeller cup 20*a* in a fixed manner. The shape of the impeller may be varied based on various parameters as long as the impeller is configured so as to take air in the axial direction and discharge the air in the radial direction.

The fan 100 includes a frame 12 having a bearing housing 121 at a middle portion thereof. The bearing housing 121 has a substantially cylindrical shape with a base connected to the frame 12. A radial bearing 34 is press-fitted and supported within the bearing housing 121. The radial bearing 34 includes a through hole extending in the axial direction at a middle portion thereof, and the shaft 32 is inserted into the through hole. In the present preferred embodiment, the radial bearing 34 is an oil-impregnated bearing made of porous material (e.g., a sintered material impregnated with lubricating oil). It should be noted, however, a roller bearing (e.g., a ball bearing) or the like may be used instead of the radial bearing 34.

Figure 10:
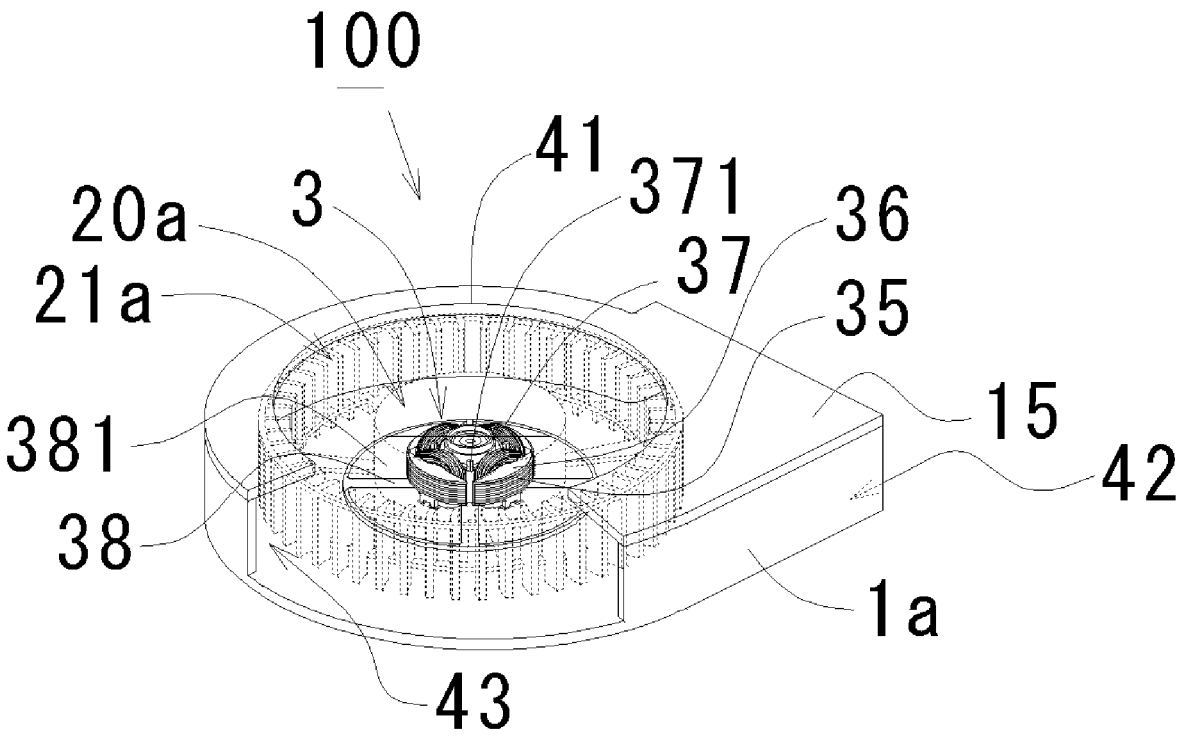
FIG. 10 is a perspective view illustrating a detailed example of a fan according to the second preferred embodiment of the present invention.

As shown in FIG. 10, a housing cover 15 is mounted on a housing 1*a* so as to define an air-outlet and an air-flow passage 43. The air taken into the fan 100 flows into the air-flow passage 43 and then is discharged from the air-outlet. The air-flow passage is a space surrounded by the housing 1*a*, the impeller 2*a*, and the housing cover 15.

A rotor yoke 31 is arranged on a radially inner circumferential surface of the impeller cup 20*a* to reduce leakage of magnetic flux to the outside of the fan 100. A rotor magnet 33, of which a radially inside portion is multipolar-magnetized, is arranged on a radially inner side of the rotor yoke 31. The impeller cup 20*a*, the impeller 2*a*, the rotor yoke 31, and the rotor magnet 33 define a cup portion 22.

A stationary part 3 is arranged radially outside of the bearing housing 121. The stationary part 3 includes a stator core 35, coils 37, an insulator 36, a circuit board 38, and a thermal conductive member 39. The stator core 35 includes a plurality of teeth, and radially-inward-tip ends of the teeth radially face the rotor magnet 33 with a gap maintained therebetween. The teeth and both axial side surfaces of the stator core 35 are covered by the insulator 36. A looped wire is provided on each of the teeth so as to form a coil 37 thereon. A circuit board 38 supplying an electric current to the coil 37 to control rotation of the impeller 2*a* is arranged at a bottom end portion of the stationary part 3 (a bottom end portion of the stator core 35 (i.e., insulator 36)). Electronic components and circuit patterns (not shown in FIG. 6) are arranged on an axially bottom side of the circuit board 38 so as to form a series of electronic circuits. As shown in FIG. 10, a pin 371, to which one end of the coil 37 is twined, is mounted on the insulator 36 in an axially penetrating manner while the pin 371 is insulated by the stator core 35. One end of the coil 37 is twined to one axial side of the pin 371, and an end of the pin 371 is inserted into a pin insertion bore 382 arranged on the circuit board 38. Then, the end of the pin 371 is soldered to the circuit board 38 such that the coil 37 is electrically connected to electronic components on the circuit board 38.

Upon providing electricity from an external power source to the coil 37 via electronic components (e.g., an IC and a Hall element arranged on the circuit board 38), a magnetic field is generated around the stator core 35. The magnetic field interacts with another magnetic field generated by the rotor magnet 33, and torque which rotates the impeller 2*a* centered about the shaft is generated. The magnetic field changes slightly based on the rotation of the rotor magnet, and the Hall element detects the change in the magnetic field. Based on the signal from the Hall element, the IC switches an output voltage such that the impeller 2*a* rotates stably. Upon rotation of the impeller 2*a*, the fan 100 takes air from an air inlet 41 and discharges air from the air-outlet 42 via the air-flow passage 43.

As previously described with respect to FIGS. 4 and 5, a heat dissipating layer 381 made of a material having a high thermal conductivity is arranged on an upper surface of the circuit board 38. In this preferred embodiment, the heat dissipating layer 381 is preferably made of a copper material, the same material as circuit patterns printed on the circuit board 38. By virtue of this configuration, the heat dissipating layer 381 may be formed simultaneously with the circuit patterns.

The heat dissipating layer 381 may be coated with solder or the like to prevent oxidation. It should be noted that the heat dissipating layer 381 may be made of any material having preferred thermal conductivity. However, the heat dissipating layer may be provided as a separate member. For example, a thermal conductive sheet may be attached to the upper surface of the circuit board 38.

The heat dissipating layer 381 is circumferentially divided into a number of areas each of which corresponds to a coil 37 arranged on each of the teeth. The coil 37 and the heat dissipating layer 381 are arranged so as to axially face each other with the thermal conductive member 39 arranged axially therebetween. The thermal conductive member 39 is in contact with the coil 37 and the heat dissipating layer 381 such that heat generated by the coil 37 is diffused to the heat dissipating layer 381. For the purpose of heat diffusion, it is advantageous that the thermal conductive member 39 has a wide contacting area with the coil 37 and the heat dissipating layer 381. In the present preferred embodiment, the thermal conductive member 39 includes a gelled material such as a thermal-conductive silicone resin, including silicone oil as a base oil and a high thermally conductive material (i.e., alumina). The thermal-conductive silicone is deformed along the shapes of the coil 37 and the heat dissipating layer 381. By virtue of this configuration, the thermal conductive member 39 may have a wide contacting area with both the coil 37 and the heat dissipating layer 381.

It should be noted, however, that the thermal conductive member 39 may be a material other than a gelled material. Taking workability into account, the thermal conductive member 39 may be a tape-like member (e.g., a thermal tape formed by applying pressure-sensitive adhesives with a filler on a supporting substrate such as polyimide film, fiberglass mat, and aluminum foil, etc.). The thermal conductive member 39 may include any material having a high thermal conductivity. However, it should be noted that the coil 37 and the heat dissipating layer 381 should be electrically isolated to preventing short circuiting the coil 37. In the present preferred embodiment, even in case that the coil 37 and the heat dissipating layer 381 are electrically connected, short circuiting of the coils does not occur since the heat dissipating layer 381 is circumferentially divided.

As shown in FIGS. 6 and 7, an outer dimension of the circuit board 38 is larger than that of the impeller cup 20*a*. Therefore, a radially outward portion of the circuit board 38 (i.e., a protruding portion) is arranged radially outside of the outer circumferential surface of impeller cup 20*a*. A portion of the heat dissipating layer 381 is arranged on the protruding portion of the circuit board 38, thus the heat dissipating layer 381 includes a portion arranged radially outside of the impeller cup 20*a*. However, it is not necessary that an entire circumference of the circuit board 38 is arranged radially outside of the impeller cup 20*a*, that is, only a portion of the circuit board 38 may be arranged radially outside of the impeller cup 20*a*.

The coil 37 generates heat in accordance with the electric resistance thereof and an amount of the electricity provided thereto. In the present preferred embodiment, the heat generated by the coil 37 is diffused to the heat dissipating layer 381 via the thermal conductive member 39. The greater an area from which the heat is dissipated from the heat dissipating layer 381, the greater the heat will automatically dissipate into the air. In addition, the air flow generated by the impeller 2*a* is provided to the heat dissipating layer 381 such that the heat diffused to the heat dissipating layer 381 is actively dissipated. Therefore, it is possible to provide more electricity to the motor to rotate the motor at a greater speed compared to a conventional motor.

Figure 9:
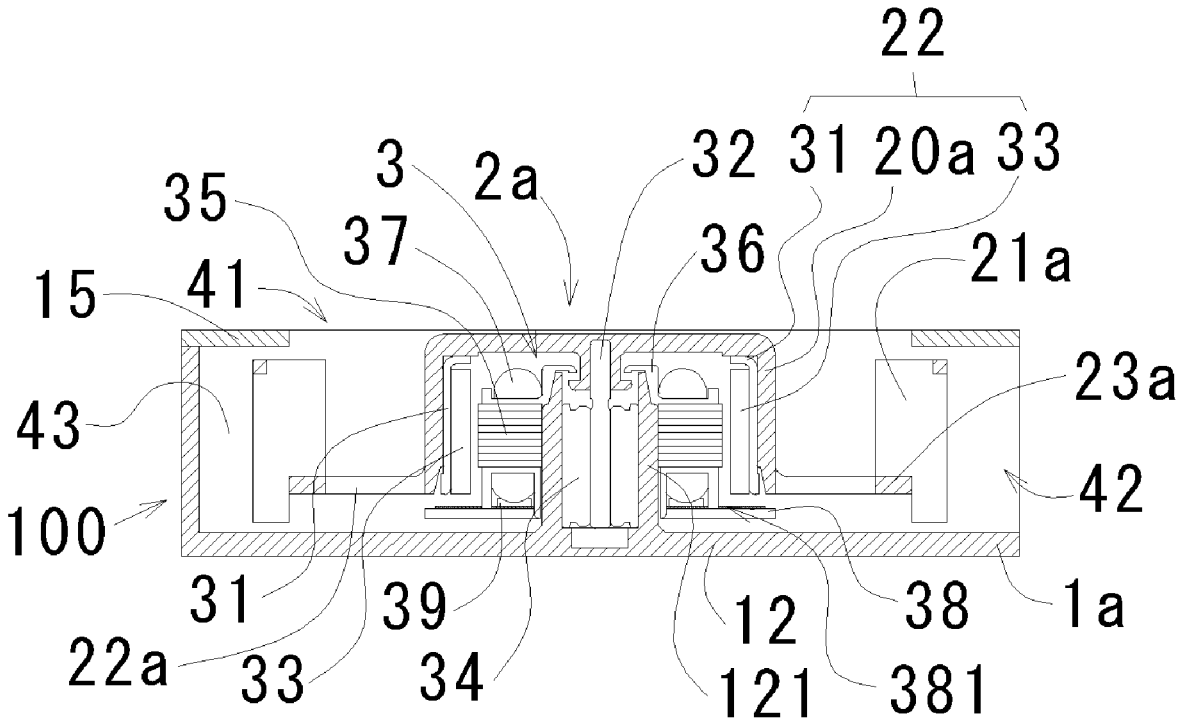
FIG. 9 is a cross sectional view of a fan according to another modified example of the second preferred embodiment of the present invention.

FIG. 9 describes a modified example of the second preferred embodiment of the present invention. A circuit board 38 illustrated in FIG. 9 is not arranged radially outside of the impeller cup 20*a*. Even in this case, air slightly flows to the outer circumferential portion of the circuit board 38. Therefore, with the heat dissipating layer 381 and the heat conductive member 39, the heat generated by the coil 37 is actively dissipated from the heat dissipating layer 381. As described above, regardless of the outer dimension of the impeller cup 20*a*, an outer dimension of the circuit board 38 may be varied based on various parameters (e.g., an electronic-component layout, air volume, static sound pressure, sound level and/or the like).

Modified Preferred Embodiments

In the description of the first and second preferred embodiments, the brushless DC motor preferably includes a plurality of blades such that the brushless DC motor is used for a fan. It should be noted, however, the scope of the present invention is not limited to a fan. A brushless DC motor having a structure in which heat generated by the coil 37 is diffused to the heat dissipating layer 381 via the thermal conductive member 39 may be used for other devices than a fan (e.g., a brushless DC motor used as a disk driving motor and the like).

In the description of the first and second preferred embodiments, the brushless DC motor is preferably an inner-rotor type motor. It should be noted, however, the present invention is applicable to an outer-rotor type brushless DC motor (i.e., a brushless DC motor in which a rotor magnet is arranged axially outward of the stator core 35 with a gap maintained therebetween).

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the present invention which fall within the true spirit and scope of the invention.

What is claimed is:

1. An electric motor comprising:

a shaft;

a stationary part including a stator core having a plurality of teeth;

a coil including a looped wire corresponding to each of the teeth of the stator core;

a cup portion having substantially a cup shape and supported rotatably relative to the stationary part by a bearing mechanism therebetween, a rotating center of the cup portion being substantially concentric relative to a center axis of the shaft;

a circuit board connected to the stationary part to supply an electric current to the coil and arranged axially below the stator core;

a heat dissipating layer made of a thermally conductive material arranged on and extending along a surface of the circuit board which axially faces the coil; and a thermal conductive member made of a thermally conductive material contacting the coil and the heat dissipating layer; wherein the heat dissipating layer is divided into a plurality of areas, each of the areas corresponding to a coil arranged at each of the teeth.

2. The electric motor as set forth in claim 1, wherein the circuit board includes a protruding portion which is arranged radially outside of the cup portion.

3. The electric motor as set forth in claim 2, wherein at least a portion of the heat dissipating layer is arranged on the protruding portion of the circuit board.

4. The electric motor as set forth in claim 1, further comprising a plurality of blades arranged around and fixed to an outer circumferential surface of the cup portion so as to rotate therewith.

5. The electric motor as set forth in claim 4, wherein the circuit board includes a protruding portion which is arranged radially outside of the cup portion.

6. The electric motor as set forth in claim 5, wherein at least a portion of the heat dissipating layer is arranged on the protruding portion of the circuit board.

7. The electric motor as set forth in claim 1, wherein the motor includes a plurality of blades which are arranged circumferentially, a connecting portion which extends radially and connects the plurality of the blades with the cup portion, and an impeller which rotates with the cup portion thereby taking in air in an axial direction and discharging the air in a radial direction.

8. The electric motor as set forth in claim 7, wherein the circuit board includes a protruding portion which is arranged radially outside of the cup portion.

9. The electric motor as set forth in claim 8, wherein at least a portion of the heat dissipating layer is arranged on the protruding portion of the circuit board.

* * * * *